United States Patent [19]

Jackson

[11] Patent Number: 5,069,100

[45] Date of Patent: Dec. 3, 1991

[54] FIBER-FREE KNIFE FOR HYDRAULIC VEGETABLE CUTTING SYSTEM

[76] Inventor: Clifford Jackson, P.O. Box 646, Burley, Id. 83318

[21] Appl. No.: 553,964

[22] Filed: Jul. 17, 1990

[51] Int. Cl.[5] ..... B26D 1/03; B26D 7/20

[52] U.S. Cl. ..... 83/857; 83/858; 83/404.3

[58] Field of Search ..... 83/402, 404.3, 857, 83/858, 932

[56] References Cited

U.S. PATENT DOCUMENTS

| | | | |
|---|---|---|---|
| 2,645,262 | 7/1953 | Marasco | 83/857 |
| 2,647,549 | 8/1953 | Koch | 83/857 |
| 4,766,793 | 8/1988 | Fischer et al. | 83/402 |
| 4,911,045 | 3/1990 | Mendenhall | 83/857 |

*Primary Examiner*—Hien H. Phan

*Attorney, Agent, or Firm*—Trask, Britt & Rossa

[57] ABSTRACT

A fiber-free cutting device for use in hydraulic conveyance vegetable cutting machines is disclosed. The cutting device utilizes cantilevered knife baldes which are attached at one end to a base support around a central open area such that the knife blades project at an angle away from the base support into an area downstream from the central open area. The cantilevered blades have a free end which overlaps the free end of an opposed knife blade such that fibers which may usually obstruct a blade are free to move along the blade to be discharged at the free end of the blade. Opposed blades are aligned so that a vegetable entering the fiber-free cutting device sees an apparent continuous cutting edge.

12 Claims, 3 Drawing Sheets

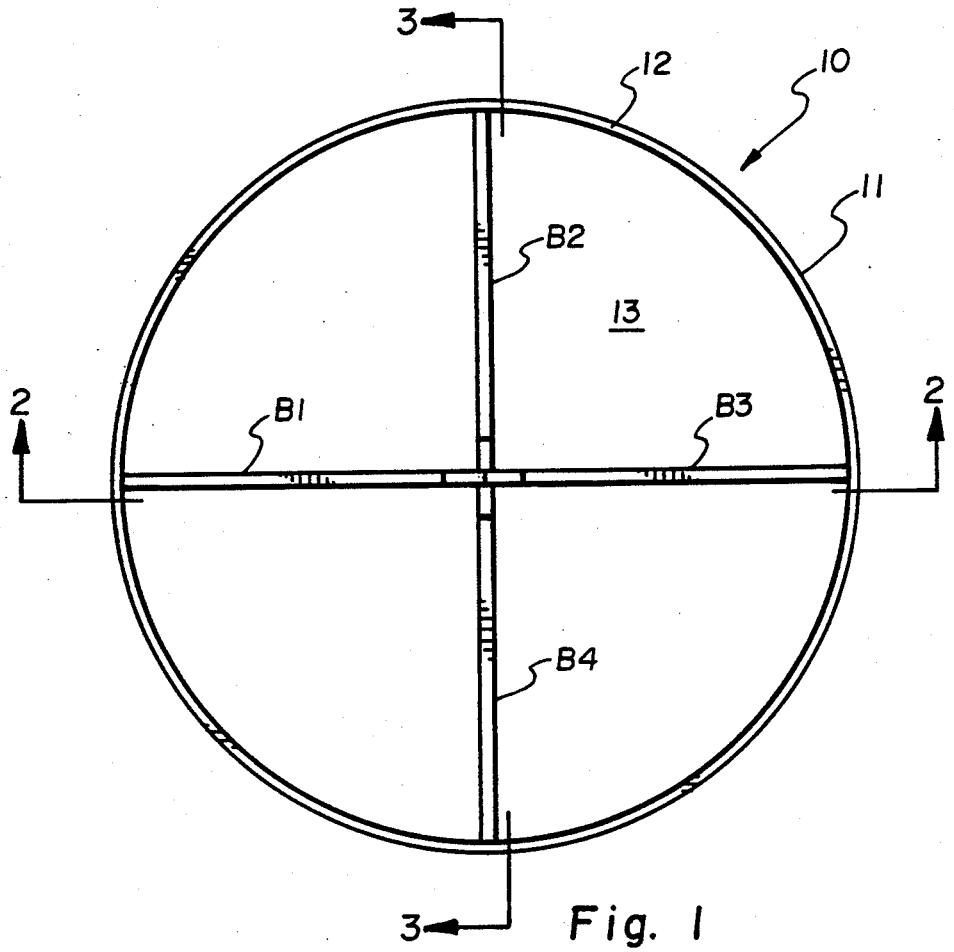
Fig. 1
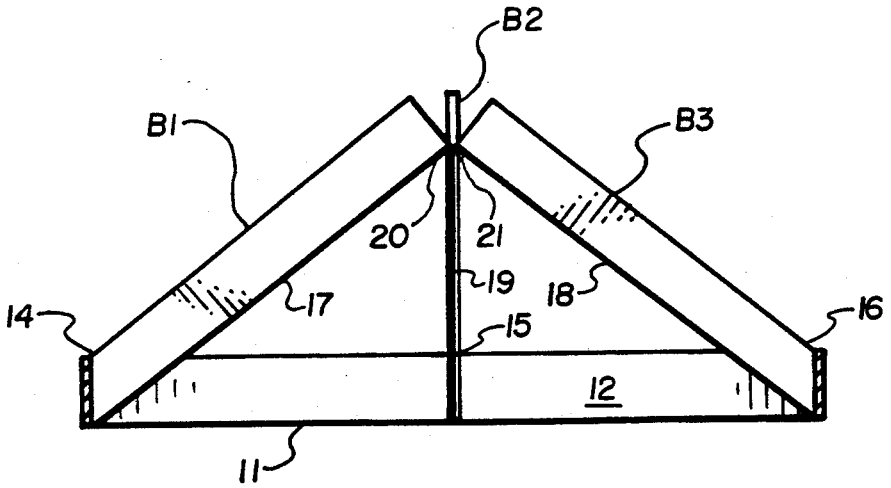
Fig. 2 (Fig. 3 ≅ Fig. 2)

FIBER-FREE KNIFE FOR HYDRAULIC VEGETABLE CUTTING SYSTEM

BACKGROUND OF INVENTION

1. Field

The instant invention relates to cutting devices which are used in hydraulic vegetable cutting machines and particularly to cutting devices which have thin knife blades which slice vegetables such as potatoes, carrots, pickles, cucumbers and the like into thin, elongated slices.

The State of the Art

Hydraulic cutting systems are well known in the art and are exemplified in the U.S. Pat. Nos. 3,109,468 and 3,116,772 to Lamb. Also other cutting devices for similar hydraulic vegetable cutting systems are disclosed in U.S. Pat. No. 4,372,184 to Fisher and U.S. Pat. No. 4,082,024 to Hodges.

These cutting devices generally have tiers of straight blades supported on each end. The blades intersect the path of a vegetable being carried in a rapidly moving liquid stream. Hydraulic cutting systems employing such stationary cutting devices were generally developed to cut potatoes although such systems are now being used to cut other vegetables such as carrots, pickles, cucumbers and the like. Generally, carrots, cucumbers, pickles and the like present more difficult problems than do potatoes because of their length to thickness ratios and because of their more fibrous nature. Especially fibrous are attached stem remnants.

Carrots, because of their length to width ratio, are in a cutting device a longer period of time and have a smaller cross sectional area against which the hydraulic force act to propel the carrot through a tiered cutting device. The problems in cutting carrots with cutting devices of the type illustrated in the Lamb, Fisher and Hodges patents above have generally precluded satisfactory results. A cutting device having improved cutting characteristics for cutting carrots is disclosed in copending U.S. patent application Ser. No. 354,117 filed on 5/19/89 of Clifford Jackson, the inventor of the invention disclosed herein, the contents of said copending application being incorporated herein by reference.

Certain problems have been experienced in using cutting devices of the type disclosed in Lamb, Fisher and Hodges with pickles and cucumbers unless the stem of the pickle or cucumber has been completely removed. The stems of pickles and cucumbers are very fibrous and the fibers tend to collect upon the straight-edged, continuous knives of the type disclosed in the above-mentioned patents. As the fibers collect, the ability of the knife to function diminishes and eventually the cutting device will jam or the cutting device will have to be removed and the blades cleaned. Frequent removal and cleaning is very detrimental to an efficient, economical slicing process.

The knife blades of the cutting devices illustrated and described in Lamb, Fisher, Hodges & Brown are continuous, straight blades supported at each end. The blades of Lamb, Fisher, Hodges & Brown are oriented perpendicular to the trajectory of vegetables passing through such cutting device. Generally, such blades are disposed in a tiered, criss-crossing manner so that multiple cross cuts of a vegetable are made.

The blades of Hodges' are "spear" shaped with the point of the "spear" directed towards the hydraulic stream flow so that a perfectly aligned vegetable contacts the "spear" point first. Besides being fixed to a support member at each end, the "spear-type" blades of Hodges' intersect one another so these blades would not function in a self-cleaning manner.

The impact of hydraulic-propelled vegetables on the cutting device blades is considerable. Thus, the blades are very sturdy and have been secured at each end to prevent flexing, etc. A discussion of this aspect of cutting devices for hydraulically-conveyed vegetables is set forth in Fisher.

SUMMARY OF INVENTION

A fiber-free knife particularly useful for cutting pickles and cucumbers into sliced in a hydraulic cutting system has been invented. The fiber-free knife comprises a base support having a central opening, which is preferably a hollow ring member, having a plurality, usually an even number, of stub-shaped knife blades attached at their proximal end and projecting at an angle away from support base into a zone down stream from the central open area of the base support. Thus, the stub-like knife blades form a "tepee"-like structure with reference to the base member except that the free ends of the knife blades do not touch or obstruct one another.

As indicated, the knife blades are usually spaced equidistantly to one another around the base support member and positioned in pairs so that one blade of a pair is located 180° from the other blade of that pair and has its cutting edge aligned and in the same plane as the cutting edge of the opposed blade. However, the free end of one blade will be slightly offset from the free end of the other blade, i.e. the tips overlap, so that the blades do no contact or obstruct one another. In this manner, any fibers which are caught on a knife blade may move along the knife blade towards the free end to be discharged at the free end by the flow of water passing over the blades and by the vegetables being cut and moving along the blades.

If a vegetable is to be sliced into quarters, then four blades are used with each preferably spaced 90° to one another around the perimeter of the base support. As indicated above, each blade of a pair of blades is aligned with its opposite member. The cutting devices are inserted in a hydraulic cutting machine such that vegetables entering the cutting device knife pass first through the central open area of the base support and then contact, farther downstream, the cutting blades of the cutting device. As the vegetables pass through the open area of the base support the vegetable "sees" one or more continuous cutting edges. Since each opposed blade has its cutting edge aligned with the cutting edge of the opposite blade and the blades are either placed at a slightly different angle so that the free end of one blade is offset slightly and is slightly displaced to the downstream side of the other blade. Also, this can be accomplished by having one blade of a pair of opposed blades slightly longer than the other blade.

DESCRIPTION OF DRAWINGS

FIG. 1 is a plan view of a multi-bladed cutter with radial blades for a hydraulic vegetable cutting apparatus.

FIG. 2 is an elevational sectional view of the cutter of FIG. 1 along section lines 2—2.

FIG. 3 is an elevational, sectional view of the cutter of FIG. 1 along section lines 2—2.

DETAILED DESCRIPTION OF INVENTION

Figure 5:
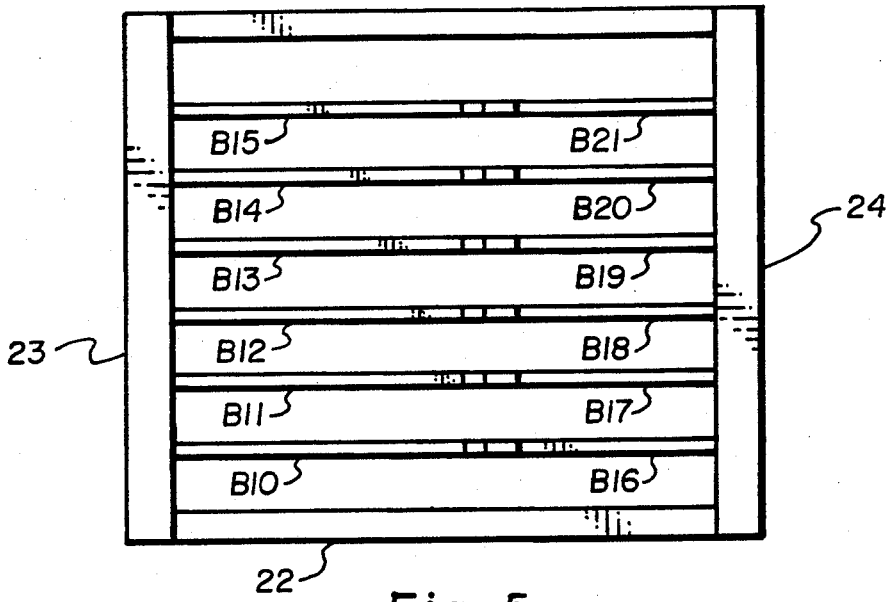
FIG. 5 is a plan view of the cutter of FIG. 4.

The instant invention involves a multi-bladed cutting device, also referred to herein as a "knife", for use in a hydraulic cutting system for slicing vegetables, especially vegetables with fibrous stems, into elongated slender slices. The bladed cutter has stub-like canti-levered blades attached at their proximal ends to a base member which has an open central space through which vegetables pass before striking the cantilevered blades.

The distal end of the stub-like blades is a free end, unattached to anything else and free from contact with adjacent or opposed blades. Each blade is slanted so that the structure, in an elevational view has a tepee-like appearance. The inner, i.e. leading edges, of the blades are sharpened. The inner or leading edge is that edge which faces the opening of the base member. Preferably, the base member is a thin-walled, circular, ring-like member having a central area that is large in comparison to the thickness of the ring wall. Square, oval, rectangular or other geometric shapes can be utilized as a shape for the base member. Generally, the height of each side wall of the base member approximates the width of the blade members. Typically, the proximal end of the blade member is welded or otherwise firmly fixed to the inner surface of the side wall of the base member.

At least two blades are fixed to the base member. Preferably, the blades are attached as aligned pairs with each blade of a pair being directly opposite the other blade. The distal ends of opposed blades are offset from one another so that the sharpened edge presented to a vegetable being thrust through the opening in the base member appears to be a continuous, straight-cutting edge from one side of the base member to the other side.

Further description of the invention may be facilitated by reference to the attached drawings. FIG. 1 is a top, plan view of the bladed device of the instant invention. The cutting device 10 has a circular, ring-like, base member 11 having a thin, rigid side wall 12 and an open central area 13. The cutting device of FIG. 1 has four knife blades attached to it each of which is spaced about 90° from the other. The knife blades B1, B2, B3 and B4 are substantially similar in size and shape. Each blade is a very thin, elongated blade which is attached at one end to the side wall 12 of the ring-like, base support 11. The diameter of the base member 11 may vary from a few inches for example, about 2 inches, up to about 6 or 8 inches, although preferably, a diameter of about 3 to about 5 inches is generally typical for the types of vegetables which are intended to be cut by this device. These vegetables are generally rather narrow and elongated.

A side, elevational view of the cutter of FIG. 1 is illustrated in FIG. 2, which is a view along the section lines 2—2 of FIG. 1. The blades B1, B2 and B3 as illustrated in FIG. 2, are shown to be attached near their fixed ends 14, 15 and 16 to the interior surface of side wall 12 of base member 11. The blades B1, B2 and B3 are attached at an angle of about 10° to about 45° with respect to a plane passing through the base of base member 11. The base member is preferably disposed in a hydraulic cutting machine perpendicularly to the fluid flow. The blade members B1, B2 and B3 are angled so that any fibrous material which collects on the blade will tend to move along the blade towards its free end to be discharged from the free end and thus not foul the cutting edge of the blade.

The cutting edge of blade B1 is at edge 17 while edge 18 is the cutting edge for blade B3. Edge 19 is cutting edge for blade B2. The free end 20 of blade B1 terminates at about the vertical axis positioned at the geometric center of the base member 11.

Figure 4:
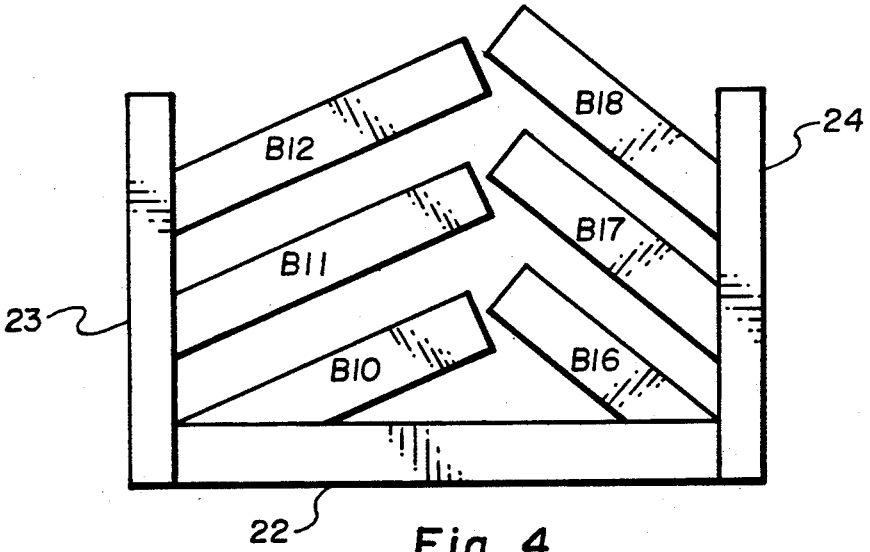
FIG. 4 is an elevation view of a multi-bladed cutter with parallel, tiered blades for a hydraulic cutting apparatus.

In FIGS. 4 and 5, a cutting device utilizing stubby, angled, parallel blades is illustrated. FIG. 4 is an elevational view of such a cutting device while FIG. 5 is a plan view.

The device in FIG. 4 is illustrated with parallel, tiered blades B10 through B21. Blades B10 and B15 are parallel to one another and set at the same angle with respect to base 22. Blades B16 and B21 are parallel to one another, positioned at the same angle with respect to base 22 and, respectively, aligned with blades B10 and B16.

Blades B11 and B14 are in the same tier, i.e., affixed at their proximal ends to vertical support 23 at the same distance from base 22. Blades B11 and B14 are attached at the same angle with respect to support 23, which preferably is the same angle as blades B10 and B15. Blades B11 and B14 are parallel to one another and aligned with blades B17 and B20. Blades B17 and B20 are affixed at their proximal ends to vertical support 23 at the same height above base number 22 which is preferably the same height as blades B11 and B14. Thus, blades B11, B14, B17 and B20 may be considered as a second tier.

Blades B12, B13, B18 and B19 form a third tier wherein the proximal end of each blade is attached at the same elevation to a vertical support. Blades B12 and B13 are set at the same angle, parallel to one another and aligned, respectively, with blades B18 and B19. Blades B18 and B19 are set at the same angle and are parallel to one another.

Figure 6:
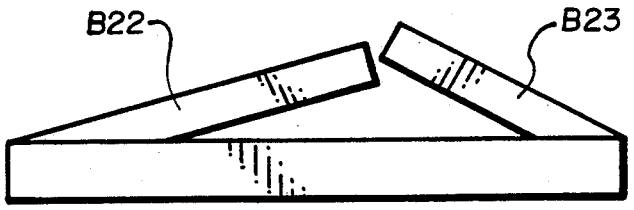
FIG. 6 is an elevational view of a multi-bladed cutter with parallel blades set as one tier.

Generally, blades B10 through B15 are set at a shallower angle with respect to base number 22 than blades B16 through B21. The elevational difference between the tiers may be very small, and in fact, the tiers may all be on the same elevation as illustrated in FIG. 6. In FIG. 4, the difference in elevation between successive tiers has been illustrated as being large in order to illustrate clearly the separateness of the tiers. Typically, the elevational difference between successive tiers will range from being very small up to about an inch.

The lateral spacing between adjacent blades is generally constant for a given cutting device although such spacing could be varied if desired. The spacing between blades B10 and B11 may range from about ⅛ inch to about ½ inch.

The stub-like blades of FIG. 6 are similar to those illustrated and described in reference to FIGS. 4 and 5.

The cutting devices of the instant have blades set at an angle with respect to the base support member of about 5° to about 60°, although preferably about 10° to about 45° with especially good results being achieved at angles of about 15° to about 30°. The base support member reference datum is a plane positioned at 90° to the central axis of the cutting device, i.e., an axis located at the geometric center of the base support member and passing through the geometric center of the projected intersection of the cutting blades.

The blades generally are all of the same length for devices of the type illustrated in FIGS. 1 through 6. However, these devices may have some blades which are longer than other blades. Typically, the blades have a length of from about one inch to about four inches, depending upon the size of the cutting device and the angle at which the blades are set. The blades may range in width from about one-fourth to about one inch and from about one-sixteenth inch to about one-eighth inch in thickness. The elevational difference between successive tiers ranges from about zero up to about one inch.

The lateral spacing between adjacent blades is generally constant for a given cutting device although such spacing could be varied if desired. The spacing between blades B10 and B11 may range from about one-eighth to about one inch, although typically the maximum spacing will be about one-half inch.

The number of blades in a cutting device such as that illustrated in FIG. 5 may vary from two to about sixteen, depending upon the number and thickness of the desired slices and the size of the vegetable being sliced.

In FIG. 6, a cutting device is illustrated which has all its blade attachments to the base at the same elevation. The device may contain a plurality of blades such that in planar, top view, the configuration would appear to be the same as that illustrated in FIG. 5. Thus, in FIG. 6, additional blades, besides blades B22 and B23 of the same length and set at the same angle, would not be visible.

The cantilevered blades useful in the cutting devices of the instant invention are sufficiently sturdy to resist flexing during slicing of hydraulically-propelled vegetables. The blades are preferably made from a rigid, stainless steel material.

Stainless steel blades may be readily welded to a base support member, which is also preferably constructed of stainless steel. Care must be exercised during construction of a cutter to ensure that opposed blades of a pair are in precise alignment. Simple jigs may be used to position accurately the stub-like blades for welding to a base member.

Figure 7:
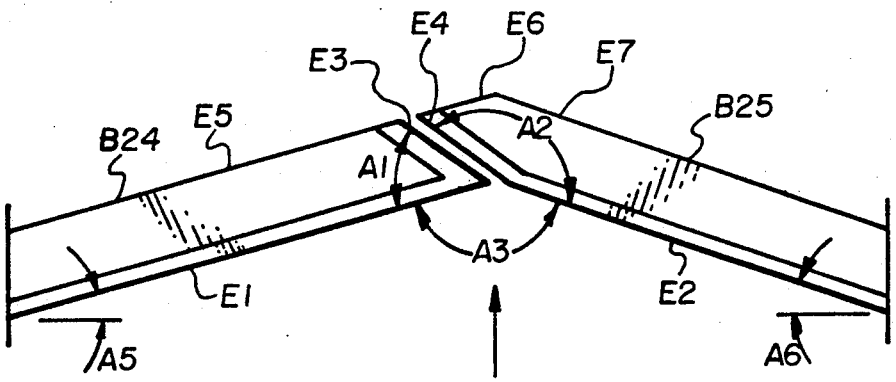
FIG. 7 is an elevational view of a pair of opposed, aligned blades having complementary, overlapping tips.
Figure 8:
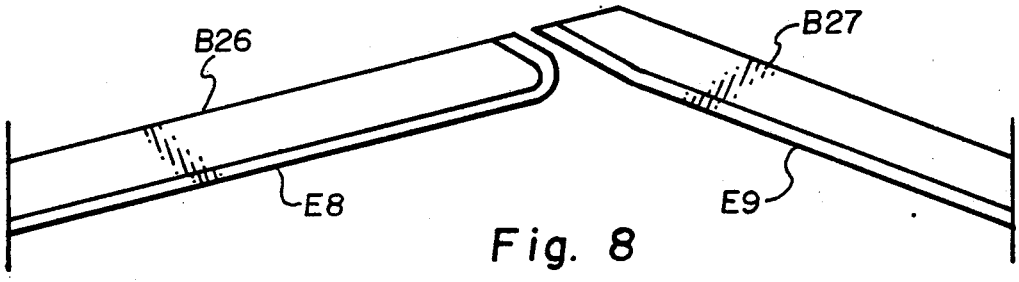
FIG. 8 is an elevational view of a pair of opposed, aligned blades having rounded, overlapping tips.

The angled blades illustrated in FIGS. 7 and 8 have a slightly different shape than the rectangular blades illustrated in FIGS. 1 through 6. Opposed rectangular blades, as illustrated in FIGS. 2, 4 and 6, are set at slightly different angles so that the tips (free ends) may overlap to present an apparent continuous cutting surface to a vegetable entering the cutting device.

In FIGS. 7 and 8, opposed blades of an aligned pair of blades may be set at the same angle by providing complementary tips on each blade. The tip of blade B24 has an acute angle between edges El, the leading (sharpened) edge, and end edge E3, which is also sharpened. The tip of blade B2 forms an obtuse angle between leading edge E2 and ends edge E4. Angles A1, A2 and A3 equal 360°. The sum of angles A5, A6 and A3 equals 180°. Thus, once A5 and A6 are selected, then the computation of the sum of angles A1 and A2 is straightforward and may be expressed by the formula: $A1+A2=360°-(180°-[A5+A6])$.

One of the objectives of modifying the blade tips to be complementary to one another is to permit blades B24 and B25 to be set at the same angle so that A5 equals A6. Thus, the equation becomes: $A1+A2=360°-(180°-2A5)$.

This equation fits the situation when edge E3 is parallel to edge E4, which is generally preferable although these edges can be non-parallel without significantly affecting the operation of the cutting device so long as a vertical gap does not exist between opposed blades. These blades are preferably of the same width and thickness.

In the above equation, if A5 and A6 are, for example, 10°, then A3 is 160° and the sum of A1 plus A2 is 200°. If A1 is selected to be 60°, then A2 is 140°. In the blade configurations illustrated in FIG. 7, A1 will generally be less than about 90° and A2 will generally be greater than 100°.

The blade structures illustrated in FIG. 8 are similar to those shown in FIG. 7 except that the cutting edges are rounded at the tips. The corners are rounded to facilitate the discharging of fibers from the ends of the knives. Also, smooth, continuous cutting edges E9 and E9 may facilitate their slicing action upon a hydraulically propelled vegetable.

Figure 9:
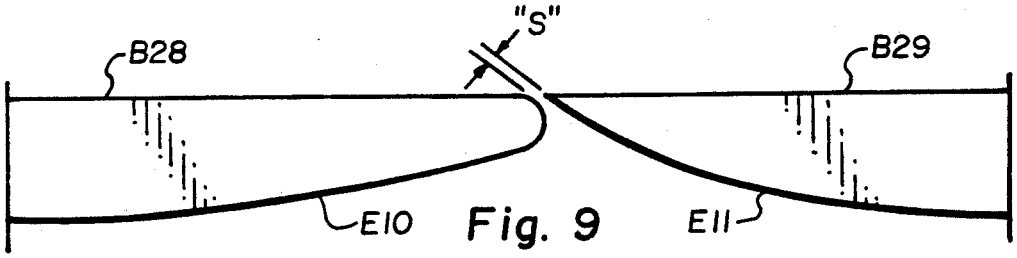
FIG. 9 is an elevational view of a pair of opposed, aligned blades having curved, self-cleaning blades.

A pair of blades B28 and B29 are illustrated in FIG. 9 which have curved, self-cleaning cutting edges E10 and E11. Since the curved edges permit debris to flow towards the ends of these blades, it is not necessary to mount the blade at an angle. The spacing "S" between opposed, aligned, over-lapping tips must be large enough to permit easy passage of fibrous material. The overlapping of the tips must be sufficient to present an apparent, continuous cutting edge to a vegetable to be sliced.

Figure 10:
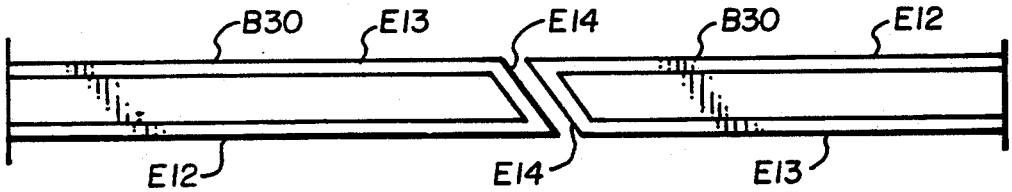
FIG. 10 is an elevational view of a pair of opposed, identical blades with one blade inverted with respect to the other.
Figure 11:
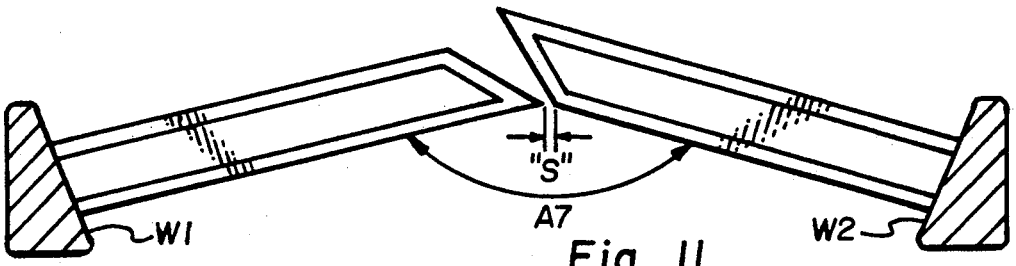
FIG. 11 is an elevational view of the blades of FIG. 10 set at a slight angle.

The blades illustrated in FIGS. 10 and 11 are identical blades with one blade inverted with respect to the other. Edges E12, E13 and E14 are sharpened. FIG. 10 shows the blades set at a zero angle while FIG. 11 shows the blades set at a slight angle so that angle A7 is less than 180°, preferably less than about 170° and more than 90° and preferably more than 120°. The rake or angle of the blades may be fixed by tapering the interior walls W1 and W2 of the base support member. Base support members may then be stacked to obtain a multi-bladed, tiered cutting device.

What is claimed is:

1. A stationary cutting device for use in a hydraulic cutting machine for cutting vegetables comprising: a peripheral blade support structure having an open central area and a circumscribing member, said support structure having cantilevered blades having a sharpened edge attached thereto which project into the open central area, arranged in pairs of blades with each blade of a pair of blades aligned and opposite to the other blade of said pair, each blade attached at its proximal end to said support structure and having a distal end which extends to at least about the geometric center of said cutting device, the edge of each blade being sharpened so that the cutting edge of each blade faces the opening of said support structure, the distal tip of each blade cutting edge slightly overlapping the distal knife tip of an opposed, aligned blade.

2. The cutting device of claim 1 wherein each blade is inclined at an angle with reference to said blade support structure.

3. The cutting device of claim 2 wherein said blades are all substantially the same size and shape.

4. The cutting device of claim 3 wherein blades of each pair of opposed, aligned blades are set at slightly different angles to said base support to enable the tip of said opposed, aligned blades to overlap.

5. The cutting device of claim 4 wherein at least two pairs of opposed, aligned blades are attached to a circular metal ring, said blades being equidistantly spaced around the interior of said ring.

6. The cutting device of claim 2 wherein the blade tip of each blade of an opposed, aligned pair of blades is shaped to complement the shape of the other blade tip to enable said tips to overlap.

7. The cutting device of claim 6 wherein the blades of one pair of opposed, aligned blades are positioned at a different elevation than another pair of opposed aligned blades.

8. The cutting device of claim 2 wherein the blade tip of each blade of an opposed, aligned pair of blades is shaped to complement the shape of the other blade tip to enable said tips to overlap.

9. The cutting device of claim 1 wherein said blades are positioned radially around the periphery of said support structure.

10. The cutting device of claim 1 wherein said blades are set at an angle of about 5° to about 60° with respect to a base support member datum which is in a plane at an angle of about 90° to the central longitudinal axis of said cutting device.

11. The cutting device of claim 1 wherein said blades have generally rectangular shape.

12. The cutting device of claim 1 wherein said blade support is a metal ring.

* * * * *